US011064735B1

(12) United States Patent
Wanxiang et al.

(10) Patent No.: US 11,064,735 B1
(45) Date of Patent: Jul. 20, 2021

(54) VAPORIZATION DEVICE WITH BOTTOM CAP

(71) Applicant: BIDI VAPOR, LLC, Grant-Valkarie, FL (US)

(72) Inventors: Zou Wanxiang, Shenzhen (CN); Qiu Ningbo, Shenzhen (CN); Zhao XingFu, Shenzhen (CN)

(73) Assignee: BIDI VAPOR, LLC, Grant-Valkarie, FL (US)

( * ) Notice: Subject to any disclaimer, the term of this patent is extended or adjusted under 35 U.S.C. 154(b) by 0 days.

(21) Appl. No.: 16/987,212

(22) Filed: Aug. 6, 2020

(51) Int. Cl.
*A24F 40/40* (2020.01)
*A24F 40/51* (2020.01)

(52) U.S. Cl.
CPC ..... *A24F 40/40* (2020.01); *A24F 40/51* (2020.01)

(58) Field of Classification Search
CPC ..... A24F 40/40; A24F 40/51
See application file for complete search history.

(56) References Cited

U.S. PATENT DOCUMENTS

| | | | | |
|---|---|---|---|---|
| 9,808,034 | B2 | 11/2017 | Hon | |
| 2012/0234315 | A1 | 9/2012 | Li et al. | |
| 2016/0128387 | A1 | 5/2016 | Chen | |
| 2017/0042242 | A1 | 2/2017 | Hon | |
| 2018/0242634 | A1* | 8/2018 | Sur | A24F 47/008 |
| 2020/0154789 | A1* | 5/2020 | Novak, III | H02J 7/0031 |
| 2020/0221779 | A1 | 7/2020 | Fu | |
| 2020/0245695 | A1 | 8/2020 | Fornarelli | |
| 2020/0281270 | A1 | 9/2020 | Potter et al. | |
| 2020/0329768 | A1 | 10/2020 | Ouyang | |
| 2020/0345073 | A1 | 11/2020 | Reevell | |

FOREIGN PATENT DOCUMENTS

| | | | |
|---|---|---|---|
| CN | 201830900 | U | 5/2011 |
| CN | 203207189 | U | 9/2013 |
| CN | 104010537 | A | 8/2014 |
| CN | 201085044 | Y | 8/2014 |

* cited by examiner

*Primary Examiner* — Eric Yaary
*Assistant Examiner* — Jennifer A Kessie
(74) *Attorney, Agent, or Firm* — BakerHostetler

(57) ABSTRACT

In one example, a vaporization device includes a housing, a heating component disposed in the housing, and a first sleeving. The heating component includes an absorbent core element and a heating coil at least partially wound around the core element. The first sleeving includes an outer wall defining a notch leading to a through hole configured to receive and fixedly secure the core element. In another example, a vaporization device includes a bottom cap including an airflow sensor, a light source, and a light guide element. The light guide element is configured to operatively secure the bottom cap to a housing and to permit illuminated light from the light source to pass therethrough. In another example, a vaporization device includes a nozzle cap defining an air inlet, an air outlet, and an air channel and including a baffle and an oil-absorbing element.

20 Claims, 10 Drawing Sheets

VAPORIZATION DEVICE WITH BOTTOM CAP

TECHNICAL FIELD

The present disclosure relates to vaporization devices, in particular, to vaporization devices in the form of simulated cigarettes or e-cigarettes in which a liquid (e.g., a nicotine-containing liquid) is atomized by a heating coil to produce vaporized aerosol to be inhaled by a user.

BACKGROUND

Conventional e-cigarettes are constructed of a unitary body, customarily with the front portion providing a power supply and the rear portion providing a heating component. In such conventional e-cigarettes, the heating component does not achieve sufficient contact with the oil storage reservoir containing the liquid, thereby resulting in ineffective and inefficient heating and vaporizing of the liquid. Some solutions include winding a heating wire around a glass fiber core and then guided out of a venting tube. However, these solutions require a complicated assembly process and are thus prone to easy damaging of the heating wire and lowered resistance of the heating wire, which undesirably decreases the useful life of the e-cigarette and the heating and vaporizing efficiency.

In addition to the foregoing, in conventional e-cigarettes, there are an unnecessary number of parts, which requires a wasteful amount of production costs and time. Moreover, in such conventional e-cigarettes, the vaporized aerosol is occasionally provided to the user at an undesirably (and potentially even dangerously) high temperature. In addition, in conventional e-cigarettes, there is insufficient liquid absorption in the nozzle cap due to inadequate contact surfaces along which the liquid can be absorbed.

Therefore, there is a need for a vaporization device (e.g., a simulated cigarette or e-cigarette) that is simple to assemble, provides efficient vaporization, and/or provides reduced temperatures of the vaporized aerosol.

SUMMARY

In one example, a vaporization device is provided. The vaporization device includes a housing. The housing has a first end and a second end opposite the first end thereof The vaporization device further includes a heating component. The heating component is disposed in the housing. The heating component includes an absorbent core element. The core element is configured to absorb a liquid. The heating component further includes a heating coil. The heating coil is at least partially wound around the core element. The heating coil is configured to be energized to produce vaporized aerosol from the liquid. The vaporization device further includes a first sleeving. The first sleeving includes an outer wall. The outer wall of the first sleeving defines a notch. The notch leads to a through hole. The through hole is configured to receive and fixedly secure the core element.

In another example, a vaporization device is provided. The vaporization device includes a housing. The housing has a first end and a second end opposite the first end thereof. The vaporization device further includes a bottom cap. The bottom cap is operatively secured to the second end of the housing. The bottom cap includes a sensor. The sensor is configured to detect air flow or air pressure or both. The bottom cap further includes a light source. The light source is configured to illuminate in response to a signal received from the sensor. The bottom cap further includes a light guide element. The light guide element is configured to operatively secure the bottom cap to the second end of the housing. The light guide element is further configured to permit illuminated light from the light source to pass therethrough.

In a further example, a vaporization device is provided. The vaporization device includes a housing. The housing has a first end and a second end opposite the first end thereof. The vaporization device further includes a nozzle cap. The nozzle cap is operatively secured to the first end of the housing. The nozzle cap defines an air inlet. The nozzle cap further defines at least one air outlet. The nozzle cap further defines an air channel. The air channel extends between the air inlet and the at least one air outlet. The nozzle cap includes at least one baffle. The at least one baffle at least partially defines a cavity within the air channel. The nozzle cap further includes an oil-absorbing element. The oil-absorbing element is at least partially disposed within the cavity.

BRIEF DESCRIPTION OF THE DRAWINGS

The following description of the illustrative examples may be better understood when read in conjunction with the appended drawings. It is understood that potential examples of the disclosed systems and methods are not limited to those depicted.

DETAILED DESCRIPTION

Figure 1A:
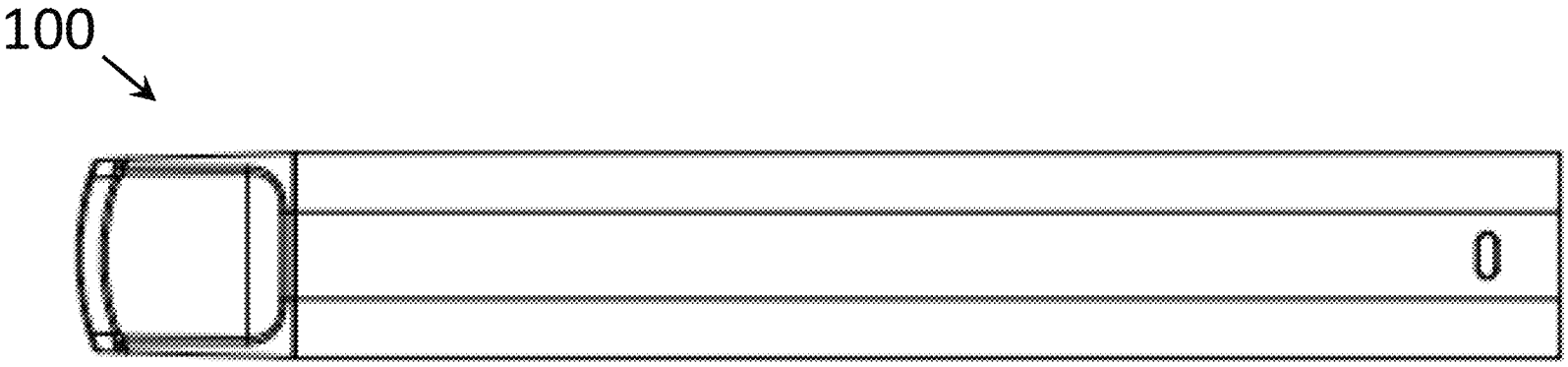
FIG. 1A shows a first side view of a vaporization device according to one example.

In the following detailed description, reference is made to the accompanying drawings, which form a part hereof. In the drawings, similar symbols identify similar components, unless context dictates otherwise. The illustrative examples described in the detailed description and drawings are not meant to be limiting and are for explanatory purposes. Other examples may be utilized, and other changes may be made, without departing from the spirit or scope of the subject matter presented herein. It will be readily understood that the aspects of the present disclosure, as generally described herein and illustrated in the drawings, may be arranged, substituted, combined, and designed in a wide variety of different configurations, each of which are explicitly contemplated and form a part of this disclosure.

While e-cigarettes have been adequate for their intended purpose, there is a need for a vaporization device (e.g., a simulated cigarette or e-cigarette) that is simple to assemble, provides efficient vaporization, and/or provides reduced temperatures of the vaporized aerosol.

As will be appreciated by those skilled in the art, the vaporization devices of the present disclosure may be used in a variety of applications. By way of non-limiting example, it is contemplated that the vaporization devices described herein may be used to provide a vaporized aerosol or smoke from a nicotine-containing liquid. In certain examples, the nicotine-containing liquid may be medical-grade nicotine (e.g., about 6%) and/or may be combined with benzoic acid, propylene glycol, and/or glycerin (e.g., vegetable glycerin), which may allow the liquid to vaporize at lower temperatures and/or produce thick clouds upon exhale.

Figure 1B:
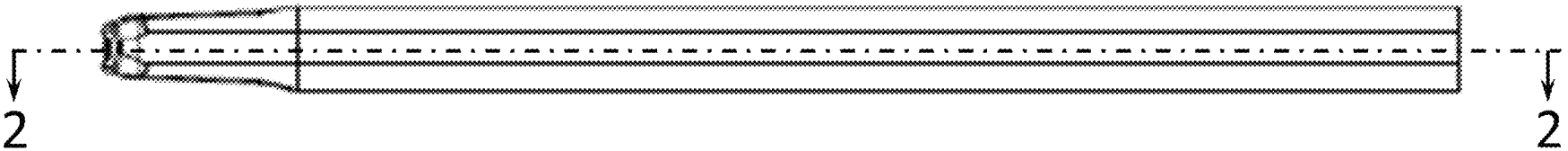
FIG. 1B shows a second side view of the vaporization device of FIG. 1A.

Referring first to FIG. 1A and FIG. 1B, an example vaporization device 100 is shown. As depicted, the vaporization device 100 may have a generally elongate body, although other examples of the disclosure are not so limited. In some examples, the vaporization device 100 may be disposable. As described in detail herein, the device 100 may be of any size, shape, and/or material as desired to suit a particular application. By way of non-limiting example, the device may have a length of about 112.5 mm, a width of about 15.5 mm, a height of about 7.0 mm, and/or a weight of about 15.7 grams.

Figure 2A:
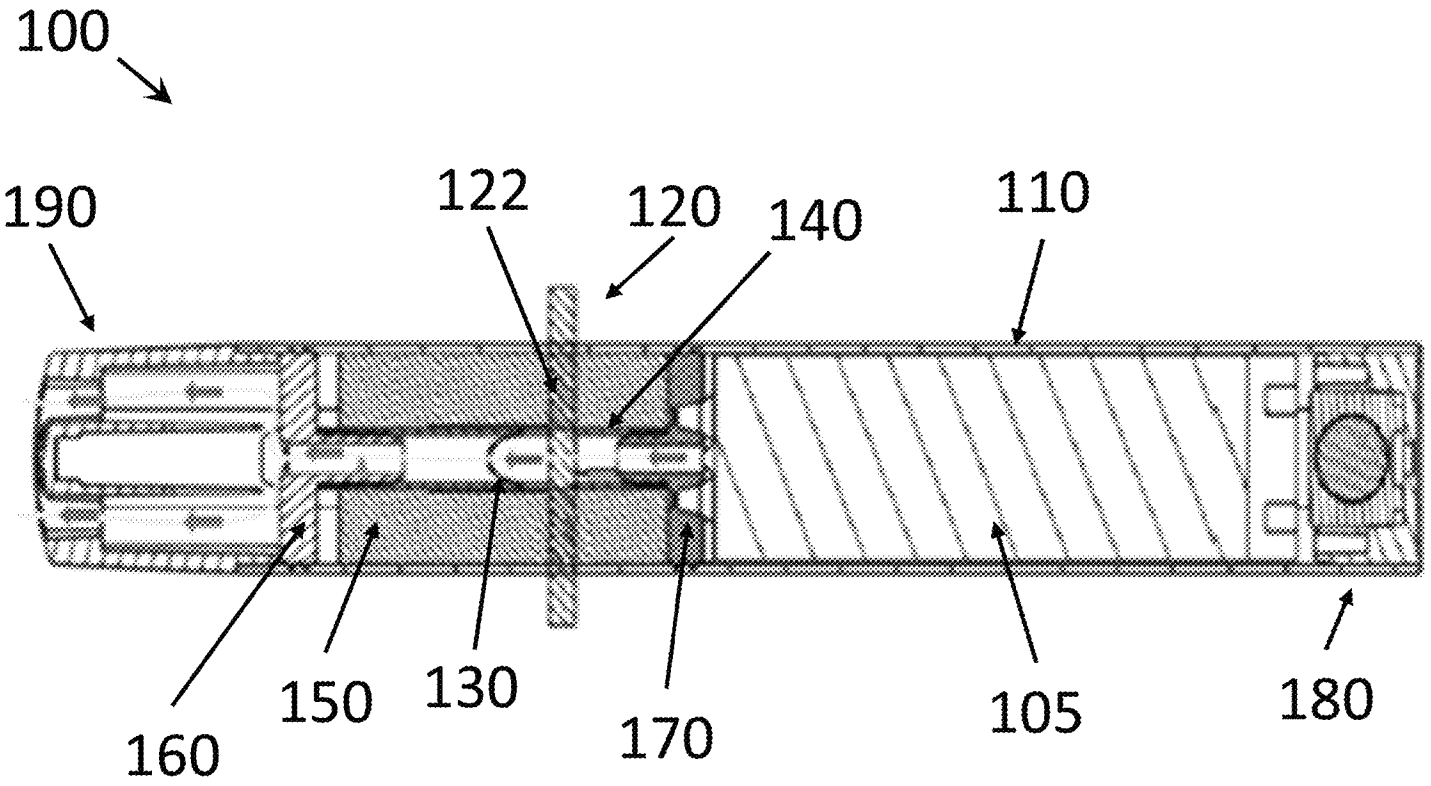
FIG. 2A shows a cross-sectional view of the vaporization device taken along line 2-2 of FIG. 1B.
Figure 2B:
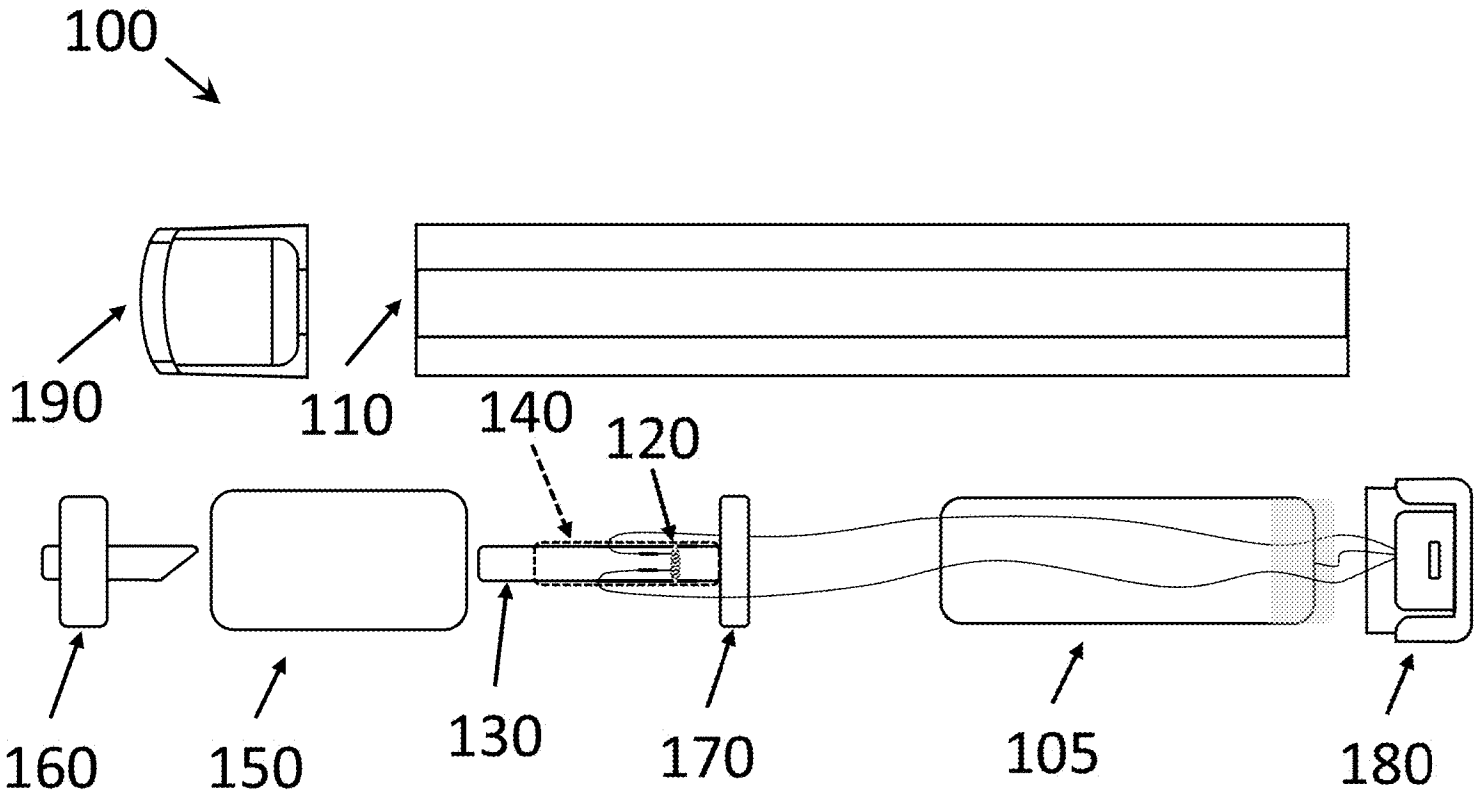
FIG. 2B shows an exploded view of the vaporization device of FIG. 1A.

The specific components of the vaporization device 100 may be seen with reference to FIG. 2A and FIG. 2B. FIG. 2A is a cross-sectional view of the vaporization device 100 taken along long 2-2 in FIG. 1B, and FIG. 2B is an exploded view of the vaporization device 100. As illustrated and explained in detail herein, the vaporization device 100 may include a battery 105, housing 110, a heating component 120, a first sleeving 130, a second sleeving 140, a reservoir 150, an upper seal 160, a lower seal 170, a bottom cap 180, and/or a nozzle cap 190.

As depicted in FIG. 2A and FIG. 2B, the vaporization device 100 may include a battery 105. The battery 105 may be disposed within the housing 110. The battery 105 may generally be in electrical communication with the heating coil 124 and may be configured to energize the heating coil 124. The battery 105 may be of any size, shape, and/or material as desired to suit a particular application. By way of non-limiting example, the battery 105 may have a length of about 47 mm, a width of about 14 mm, and/or a height of about 5 mm. The battery 105 may, in certain examples, be made a ternary polymer lithium battery. In some examples, the battery 105 may be a lithium cobalt battery. The battery 105 may have a capacity of about 280 mAh. In examples, the battery capacity may relate to the capacity of the reservoir 150, as described below. For instance, a battery capacity for battery 105 can be provided that matches the amount of energy required to vaporize the fluid stored in the reservoir 150. Such battery capacity may also include an energization amount over the minimum energy required to vaporize all fluid stored in the reservoir 150 to provide additional battery capacity approximating for inefficiencies in vaporization owing to the need to repeatedly re-energize the heating coil 124 from ambient or below-vaporization temperature between uses or periods of vaporization. In examples, the battery 105 may be capable of being remanufactured or reused. For instance, the battery 105 may be configured to be removable from the device, remanufactured (e.g., recharged or reenergized), and then reinstalled into another device (e.g., a remanufactured device). This may advantageously increase the useful life of the battery and decrease waste. In examples, the battery 105 may be configured to have a maximum output voltage of about 4.25 volts, a resistance of about 2.5 Ohms, and/or a maximum output current of about 1.7 amps. In examples, the device 100 may generally be configured to have a minimum operating voltage of about 3.2 volts, and the battery 105 may generally be configured to provide the minimum operating voltage.

Figure 3:
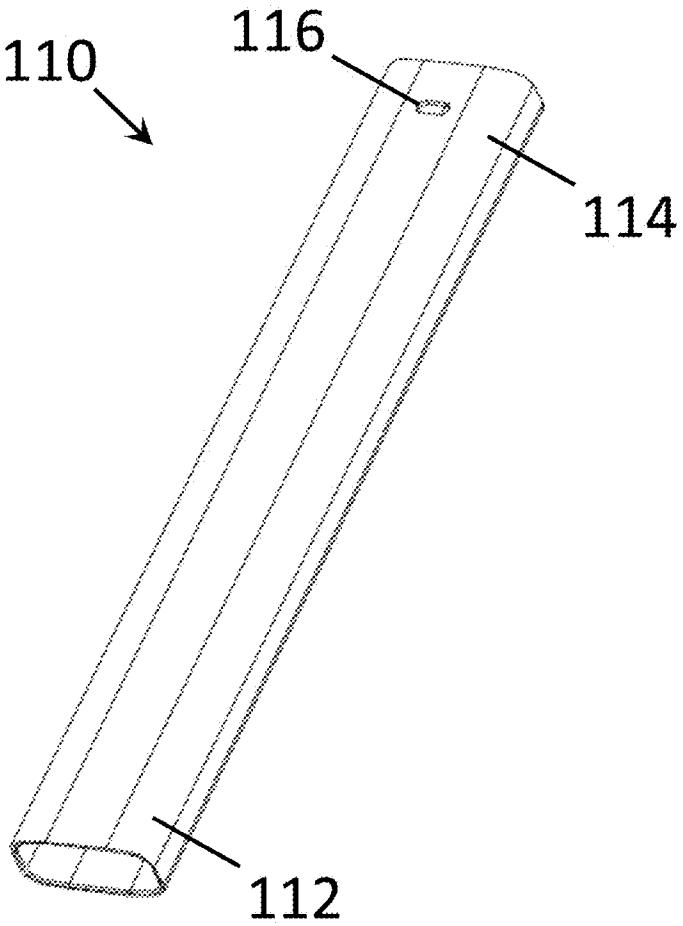
FIG. 3 shows an isometric view of a housing of the vaporization device of FIG. 1A according to one example.

As shown in FIG. 3, the housing 110 is generally an elongate member, although other examples of the disclosure are not so limited. The housing 110 includes a first end 112 and a second end 114. The first end 112 of the housing 110 is generally positioned opposite the second end 114 of the housing 110 and the housing 110 extends therebetween. As will be described in more detail herein, a viewing panel 116 may be provided proximate the second end 114 of the housing 110. The housing 110 may be of any size, shape, and/or material as desired to suit a particular application. In general, the housing 110 is sized and shaped so as to be comfortably and conveniently held in a user's hand. By way of non-limiting example, the housing 110 may have a length of about 96 mm, a width of about 15.5 mm, and/or a height of about 7 mm. The housing 110 may, in certain examples, be made of aluminum. In examples, the housing 110 may have beveled outer edges, which may provide a more ergonomic feel for the user.

Figure 4:
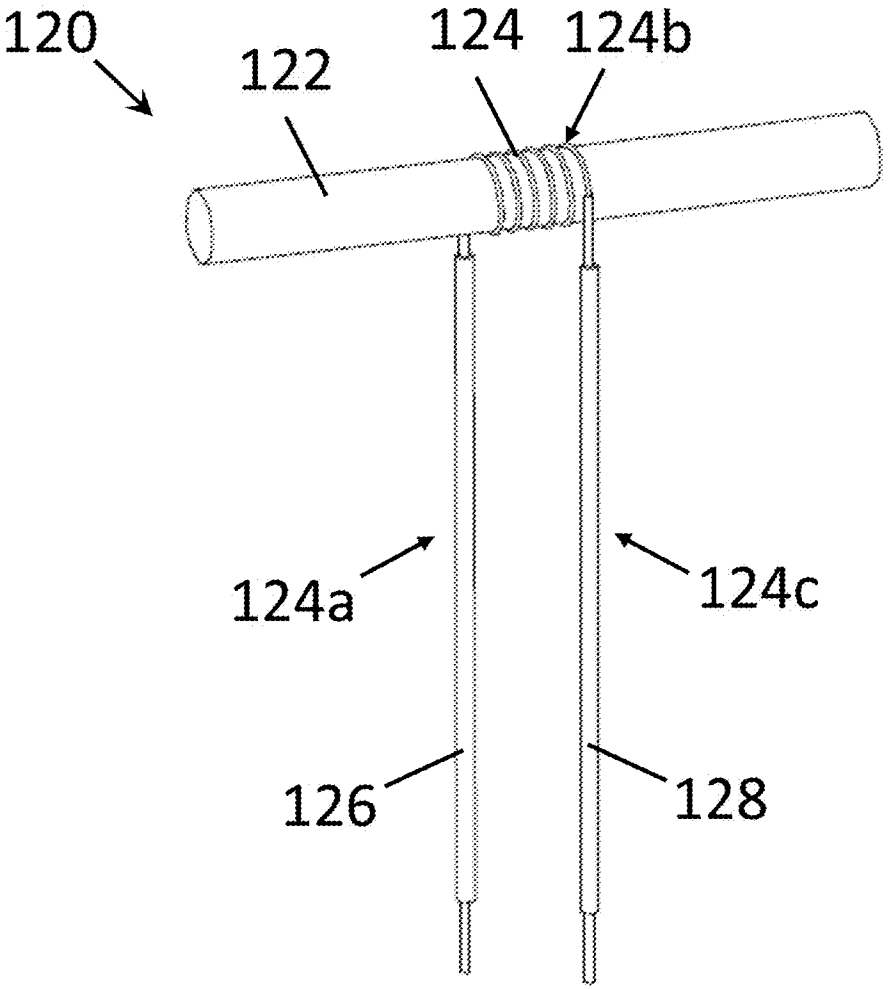
FIG. 4 shows an isometric view of a heating component of the vaporization device of FIG. 1A according to one example.

Turning now to FIG. 4, aspects of the heating component 120 can be seen. As will be understood with reference to FIG. 2A and FIG. 2B, the heating component 120 may be disposed in the housing 110. The heating component 120 includes a core element 122. The core element 122 may be an absorbent core element. In this way, the core element 122 may be configured to absorb and/or store a liquid therein. The core element 122 may, in certain examples, serve as a temporary storage reservoir for the liquid to be vaporized. In some examples, the core element 122 may be in the form of an elongate rod or tube, although other examples of the disclosure are not so limited. As will be appreciated by those skilled in the art and may be understood with reference to FIG. 2A, the core element 122 may interface with (i.e., be in fluid communication with) the reservoir 150 and draw the liquid therefrom onto the core element 122. The core element 122 may be of any size, shape, and/or material as desired to suit a particular application. By way of non-limiting example, the core element 122 may have a length of about 19 mm, a diameter of about 2 mm, and/or a mass of about 0.8 g. The core element 122 may, in certain examples, be made of cotton (e.g., organic cotton). In some examples, the core element 122 may be in the form of a cotton rope, oil-conducting wool, or other absorbent material. The core element 122 described herein may overcome some of the disadvantages of conventional glass fiber cores, which are prone to the dusting of potentially harmful metals or fibers into the vaporized aerosol, which may disadvantageously and potentially dangerously be provided to the user (e.g., by the ceramic coil breaking and releasing silica powder, which is harmful to the user's health).

With continued reference to FIG. 4, the heating component 120 also includes a heating coil 124. The heating coil 124 may be in the form of a wire. In this way, at least a portion of the heating coil 124 may be wound around the core element 122. The heating coil 124 may, in certain examples, may serve to heat the liquid drawn onto the core element 122. In examples, the heating coil 124 may be configured to be energized to produce a vaporized aerosol from the liquid. The liquid may, in certain examples, be vaporized through absorption as the liquid is drawn in by the core element 122. That is, in examples, generally only the liquid that has been drawn in by the core element 122 is heated by the heating coil 124; the remainder of the liquid stored in the reservoir 150 (e.g., generally around the heating component 120) remains unheated. This may advantageously obviate the need to continuously reheat a large amount of liquid (e.g., the remainder of the liquid in the reservoir 150), which may lead to a fresher and more consistent experience for the user during each pull of vaporized aerosol and the prevention of molecular breakdown of the liquid (e.g., a nicotine-containing liquid). This may also advantageously avoid the user from being provided with vaporized aerosol having an undesirable burning taste or flavor as is known to occur in existing e-cigarettes. The liquid may be drawn in by the core element 122 and/or heated by the heating coil 124 in response to a signal from a sensor 182, as described herein (e.g., a signal indicating suction or negative pressure). Upon heating the liquid via the heating coil 124 to produce a vaporized aerosol or smoke, the vaporized aerosol or smoke may generally travel along the flow path illustrated with arrows in FIG. 2A.

In the example illustrated in FIG. 4, the heating coil 124 may include a first end portion 124*a* and a second end portion 124*c*. An intermediary portion 124*b* of the heating coil 124 may be positioned between the first and second end portions 124*a*, 124*c*. In examples, the intermediary portion 124*b* of the heating coil 124 may be crimped to the first and second end portions 124*a*, 124*c* of the heating coil 124. In other examples, the intermediary portion 124*b* of the heating coil 124 may be soldered or otherwise attached to the first and second end portions 124*a*, 124*c* of the heating coil 124. The intermediary portion 124*b* of the heating coil 124 may extend directly between the first and second end portions 124*a*, 124*c* of the heating coil 124. In examples, the intermediary portion 124*b* and the first and second end portions 124*a*, 124*c* of the heating coil 124 may each be portions of a single, unitary wire that extends between the positive and negative terminals 105*a*, 105*b* of the battery 105*a*. Although the intermediary portion 124*b* of the heating coil 124 may be connected to the first and second end portions 124*a*, 124*c* of the heating coil 124 as described above, it is to be understood that the intermediary portion 124*b* and the first and second end portions 124*a*, 124*c* of the heating coil 124 may each be portions of the same wire, with the intermediary portion 124*b* disconnected (e.g., cut) from the first and second end portions 124*a*, 124*c* to ease the process of winding the intermediary portion 124*b* of the heating coil 124 about the core element 122 and reconnected thereafter (e.g., crimped, soldered). The heating coil 124 may be electrically connected directly to the battery 105, and the heating coil 124 may be defined by a single, continuous wire having a substantially constant resistance (e.g., about 2.5 Ohms) over its entire length as it extends from the positive terminal 105*a* of the battery, winds around the core element 122, and extends to the negative terminal 105*b* of the battery 105. In other related examples, the heating coil 124 may include multiple portions of the same or substantially the same wire (e.g., the same or substantially the same materials and thermal properties, such as resistance) joined together (e.g., crimped, soldered) to form the entirety of the heating wire 124. In each of the examples described herein, the heating coil 124 may generally have a substantially constant resistance over its entire length as it extends from the positive terminal 105*a* of the battery, winds around the core element 122, and extends to the negative terminal 105*b* of the battery 105, as described herein. This may allow for the user of lower resistance wires as compared to existing e-cigarettes and/or may provide better heat management and battery draw. The heating coil 124 (e.g., the wires thereof) may provide advantages over the wiring used in existing e-cigarettes, which conventionally use wires of differing materials or differing resistance between the heating coil and the connections to the battery. In such existing e-cigarettes, this results in more expensive, difficult, time-consuming, and generally inefficient manufacturing and assembly processes.

As can be seen in FIG. 4, the intermediary portion 124*b* may be wound around the core element 122. In contrast, in this example, the first and second portions 124*a*, 124*c* may not be wound around the core element 122. The first end portion 124*a* may be at least partially disposed within a first tube 126. Similarly, the second end portion 124*c* may be at least partially disposed within a second tube 128. The heating coil 124 (and components thereof) may be of any size, shape, and/or material as desired to suit a particular application. By way of non-limiting example, the heating coil 124 may have a diameter of about 0.12 mm and/or a resistance of about 2.5 Ohms. In other examples, the heating coil 124 can have a greater or smaller diameter and/or greater or smaller resistance, either or both of which can be based on the size or capacity of the reservoir 150 and/or the type of fluid in the reservoir 150. The heating coil 124 may, in certain examples, include a nickel-chromium alloy. The heating coil 124 may, in certain examples, be a nickel-chromium wire. By way of further non-limiting example, the first and second tubes 126, 128 may each have an outer diameter of about 0.5 mm, an inner diameter of about 0.25 mm, and/or a length of about 22 mm. The first and second tubes 126, 128 may, in certain examples, each be made of a polytetrafluoroethylene (PTFE) material (e.g., Teflon). In some examples, the first and second tubes 126, 128 may serve to insulate a portion of the heating coil 124 (e.g., the non-wound first and second end portions 124*a*, 124*c* of the heating coil 124). By way of further non-limiting example, the first and second end portions 124*a*, 124*c* of the heating coil 124 may have exposed leads (i.e., uncovered areas on opposing ends of each of the first and second tubes 126 and 128, respectively) of about 2 mm. By way of further non-limiting example, the intermediary portion 124*b* of the heating coil 124 may have a length of about 3 mm. Put another way, in certain examples, about 3 mm of the heating coil 124 may be wound around the core element 122, although other examples of the disclosure are not so limited.

Figure 13:
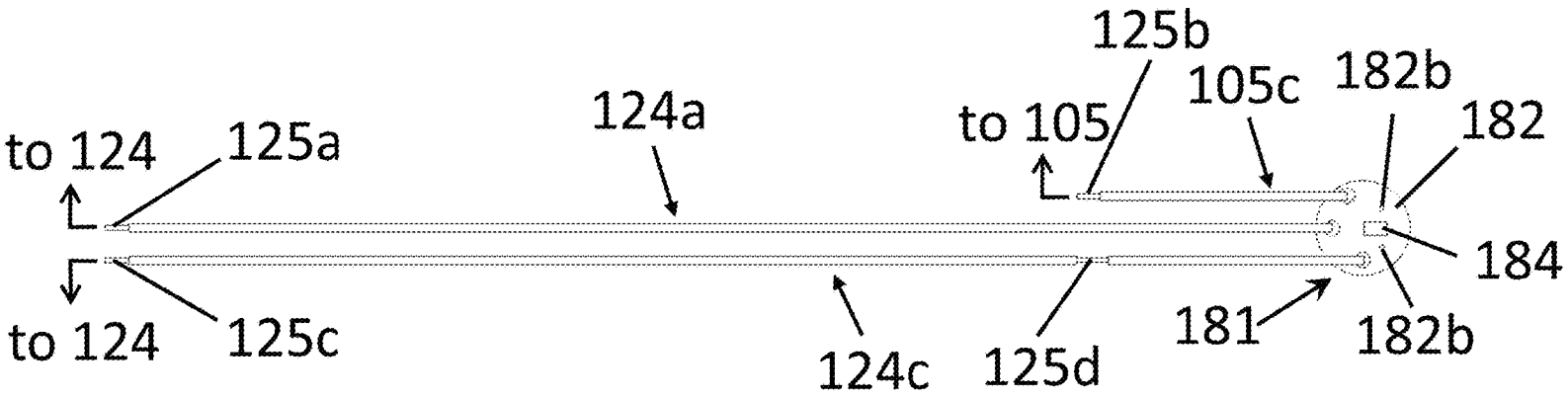
FIG. 13 shows a top view of a controller, sensor, and wires of the vaporization device of FIG. 1A according to one example.

With reference to FIG. 13, the first and second end portions 124*a*, 124*c* of the heating coil 124 may extend to the controller 181 and/or the sensor 182. In this way, the heating coil 124 may be electrically connected directly to the battery 105. In examples, a wire 105*c* may electrically connect the controller 181 and/or the sensor 182 to the positive terminal 105*a* of the battery 105 (e.g., proximate connection point 125*b*). The first end portion 124*a* of the heating coil 124 may electrically connect the controller 181 and/or the sensor 182 to the intermediary portion 124*b* of the heating coil 124 wound around the core element 122 (e.g., proximate connection point 125*a*). As will be appreciated by those skilled in the art, the first end portion 124*a* of the heating coil 124 may send and/or receive signals between the controller 181 and/or the sensor 182 and the heating coil 124. The second end portion 124*c* of the heating coil 124 may electrically connect the controller 181 and/or the sensor 182 to the negative terminal 105*b* of the battery 105 (e.g., proximate connection point 125*d*) and may further electrically connect the negative terminal 105*b* of the battery 105 to the intermediary portion 124*b* of the heating coil 124 wound around the core element 122 (e.g., proximate connection point 125*c*). As will be appreciated by those skilled in the art, the second end portion 124*c* of the heating coil 124 may send and/or receive signals between the controller 181 and/or the sensor 182 and the heating coil 124. The connection points 125*a-d* may be a crimped joint, a solder joint, or the like. As described herein, the connection points 125*a-d* may, in some examples, be connections along a single, continuous wire of substantially constant resistance. In other examples, the connection points 125*a-d* may serve to interconnect sections of substantially identical wire of substantially constant resistance (i.e., with the connection points joining portions of the same or substantially the same wire having the same or substantially same materials and thermal properties, such as resistance). As described herein, the heating coil 124 may generally be energized by the battery 105. In examples, the maximum voltage to the heating coil 124 may be about 3.6 volts, the maximum current flow to the heating coil 124 may be about 1.5 amps, and/or the maximum power output to the heating coil 124 may be about 5.4 watts. In further examples, the heating coil 124 may be configured to heat the liquid when the voltage to the heating coil 124 is about 3.2 volts or greater.

Figure 5B:
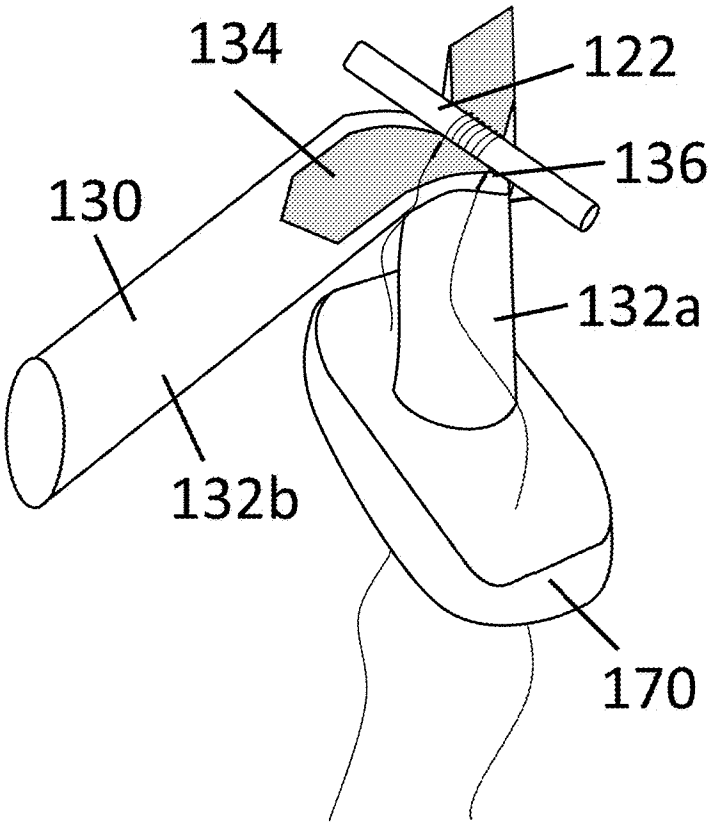
FIG. 5B shows a photograph of the first sleeving of FIG. 5A in use with the heating component of FIG. 4.
Figure 5A:
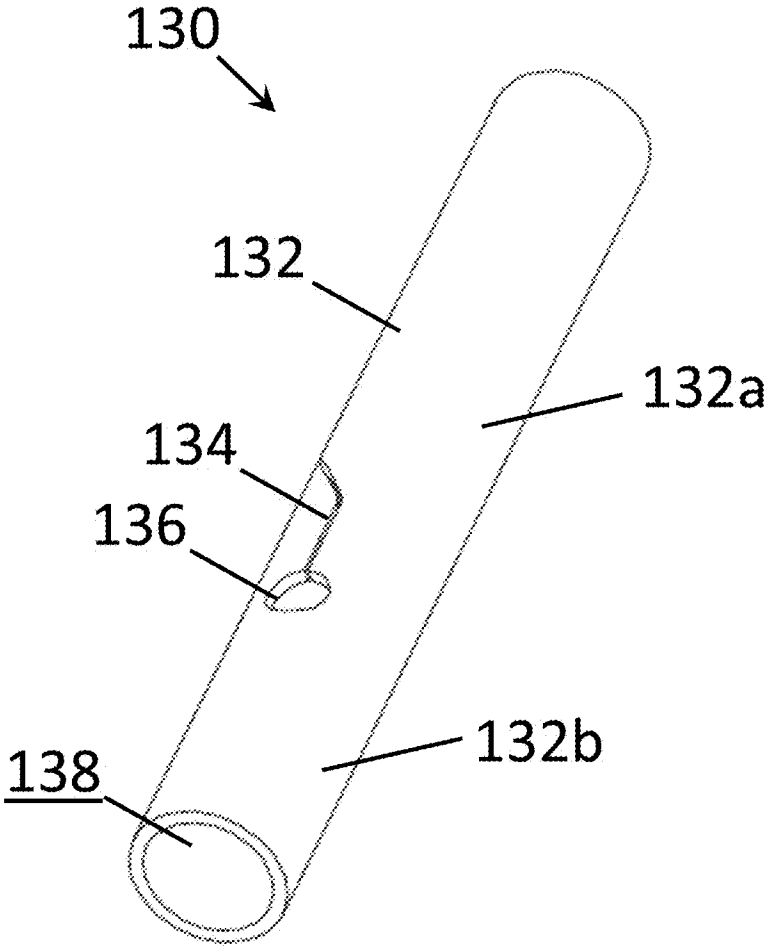
FIG. 5A shows an isometric view of a first sleeving of the vaporization device of FIG. 1A according to one example.

Turning now to FIG. 5A and FIG. 5B, aspects of the first sleeving 130 may be seen. As will be understood with reference to FIG. 2A and FIG. 2B and as explained in detail herein, the first sleeving 130 may be configured to receive and fixedly secure the heating element 120 (e.g., the core element 122 thereof) within the housing 110. As depicted, the first sleeving 130 may be in the form of an elongate rod or tube, although other examples of the disclosure are not so limited. The first sleeving 130 may, in some examples, serve as a venting tube. The first sleeving 130 may include an outer wall 132. The outer wall 132 may generally define and/or bound an interior 138 of the first sleeving 130. The interior 138 of the first sleeving 130 may, in some examples, be a hollow interior designed to receive and accommodate at least a portion of the heating component 120 therein and/or therethrough.

The outer wall 132 of the first sleeving 130 may define a notch 134. Generally, the notch 134 may extend entirely through the outer wall 132 of the first sleeving 130 into the interior 138 of the first sleeving 130. The notch 134 may lead to and communicate with a through hole 136. As may be best understood with reference to FIG. 5B, the through hole 136 may pass completely through the outer wall 132 of the first sleeving 130. In this way, as will be understood, the through hole 136 may generally define two openings through the outer wall 132 of the first sleeving 130. As will be further understood, the notch 134 generally extends between and interconnects the two openings defined by the through hole 136. As such, as may be understood from FIG. 5B, a first portion 132*a* of the outer wall 132 of the first sleeving 130 may be bent, pulled, pressed, deflected, or otherwise moved relative to a second portion 132*b* of the outer wall 132 of the first sleeving 130 so as to permit insertion of the heating component 120 into the first sleeving 130. In examples, such as is shown in FIG. 5B, the core element 122 of the heating component 120 may generally extend through the through hole 136 in the outer wall 132 of the first sleeving 130. Once the core element 122 is received in the through hole 136, the first portion 132*a* of the outer wall 132 may be bent, pulled, pressed, deflected, or otherwise moved relative to the second portion 132*b* (e.g., to the initial, closed position shown in FIG. 5A). In this way, the through hole 136 may receive and fixedly secure the core element 122 in place within the housing 110. This process of assembling the heating component 120 and first sleeving 130 provides a stable and efficient assembly process that is quicker and better than is done in conventional e-cigarettes. Although the first portion 132*a* of the outer wall 132 is described as being moved relative to the second portion 132*b* of the outer wall 132, it is to be readily understood that the second portion 132*b* of the outer wall 132 could instead be moved relative to the first portion 132*a* of the outer wall 132 and/or each of the first and second portions 132*a*, 132*b* of the outer wall 132 could each be moved relative to one another to open the outer wall 132 and accommodate receiving the core element 122 heating component 120 in the through hole 136.

The first sleeving 130 may be of any size, shape, and/or material as desired to suit a particular application. By way of non-limiting example, the first sleeving 130 may have a length of about 28.5 mm, an outer diameter of about 4 mm, and/or an inner diameter of about 3.3 mm. By way of further non-limiting example, the notch 134 may have a length of about 7.5 mm. By way of further non-limiting example, the through hole 136 may have a diameter of about 1.6 mm. Generally, the notch 134 may have a width that is less than a diameter of the through hole 136. In examples, the cross-sectional shape of the notch 134 axially along the first sleeving 130 may be two lines or surfaces oriented at an obtuse angle relative to one another (refer to FIG. 5A), although other examples of the disclosure are not so limited. The first sleeving 130 may, in certain examples, be made of fiberglass.

Figure 6:
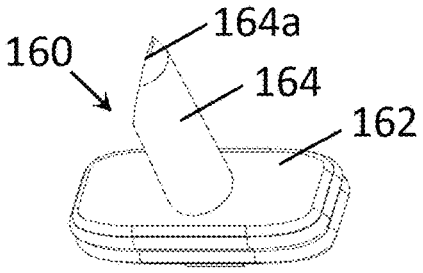
FIG. 6 shows an isometric view of an upper seal of the vaporization device of FIG. 1A according to one example.

With reference now to FIGS. 6-9, other components of the vaporization device 100 may be seen. FIG. 6 depicts a first seal 160. The first seal 160 may also be referred to as an upper seal or nozzle cap seal. With reference to FIG. 2A and FIG. 2B as well, the first seal 160 may be positioned proximate the first end 112 of the housing 110. In examples, the first seal 160 may be positioned between the nozzle cap 190 and the reservoir 150. In this way, the first seal 160 may prevent or retard the leakage of liquid into the nozzle cap 190. The first seal 160 may include a base 162 and a nipple 164 extending outwardly away the base 162. The nipple 164 may be tapered at its distal end 164*a*. The nipple 164 may include an opening or channel extending therethrough to permit the passage of vaporized aerosol therethrough to the nozzle cap 190. In this regard, as may be understood from FIG. 2A and FIG. 2B, the first seal 160 may interface directly with the first sleeving 130 to receive the vaporized aerosol therethrough (refer to the vaporized aerosol or smoke flow path illustrated with arrows in FIG. 2A). The nipple 164 may assist in keeping the first seal 160 aligned within the housing 110, thereby preventing motion of the first seal 160 and maintaining a strong seal (e.g., a fluid-tight seal). The first seal 160 may be of any size, shape, and/or material as desired to suit a particular application. By way of non-limiting example, the first seal 160 may have a length of about 16.5 mm. By way of further non-limiting example, the nipple 164 may have a diameter of about 3.6 mm, a length of about 12 mm, and/or a width of about 3.6 mm. By way of further non-limiting example, the base 162 may have a length of about 15 mm, a width of about 6.5 mm, and/or a height of about 3 mm. By way of further non-limiting example, the opening or channel extending through the nipple 164 may have a diameter of about 2 mm. The first seal 160 may, in certain examples, be made of a silica gel (e.g., 60° silica gel). The first seal 160 may, in certain examples, be resistant (e.g., avoid substantial changes to material properties or performance) at elevated temperatures (e.g., 250° C.). In examples, the first seal 160 may be dimensioned for an interference fit within the housing 110 (i.e., by being fit into the housing 110 after slight compression).

Figure 7:
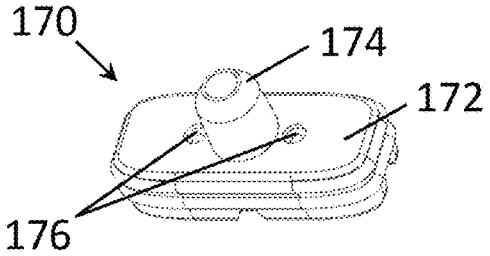
FIG. 7 shows an isometric view of a lower seal of the vaporization device of FIG. 1A according to one example.

FIG. 7 depicts a second seal 170. The first seal 170 may also be referred to as a lower seal or bottom cap seal. With reference to FIG. 2A and FIG. 2B as well, the second seal 170 may be positioned proximate the second end 114 of the housing 110. In examples, the second seal 170 may be positioned between the heating component 120 and the bottom cap 180 and/or battery 105. In this way, the second seal 170 may prevent or retard the leakage of liquid into the bottom cap 180 and/or to the battery 105. In some examples, the second seal 170 may support and/or accommodate the wires of the heating coil 124. For instance, the second seal 170 may include a pair of openings 176 sized and shaped to permit the wires of the heating coil 124 to pass therethrough. The second seal 170 may include a base 172 and a nipple 174 extending outwardly away the base 172. The nipple 174 may assist in keeping the second seal 170 aligned within the housing 110, thereby preventing motion of the second seal 170 and maintaining a strong seal (e.g., a fluid-tight seal). The second seal 170 may be of any size, shape, and/or material as desired to suit a particular application. By way of non-limiting example, the second seal 170 may have a length of about 7.9 mm. By way of further non-limiting example, the nipple 174 may have a diameter of about 1.8 mm, a length of about 12 mm, and/or a width of about 3.6 mm. By way of further non-limiting example, the base 172 may have a length of about 15 mm, a width of about 6.5 mm, and/or a height of about 3.8 mm. By way of further non-limiting example, each opening 176 may have a diameter of about 1.8 mm. The second seal 170 may, in certain examples, be made of a silicon rubber (e.g., 60° silicon rubber). In examples, the second seal 170 may be made of a first material (e.g., 60° silicon rubber) and the first seal 160 may be made of a second material (e.g., 60° silical gel) different from the first material. In other examples, the first and second seals 160, 170 may be made of the same material and have the same or different hardnesses. The second seal 170 may, in certain examples, be resistant (e.g., avoid substantial changes to material properties or performance) at elevated temperatures (e.g., 250° C.). In examples, the second seal 170 may be dimensioned for an interference fit within the housing 110 (i.e., by being fit into the housing 110 after slight compression).

Figure 8:
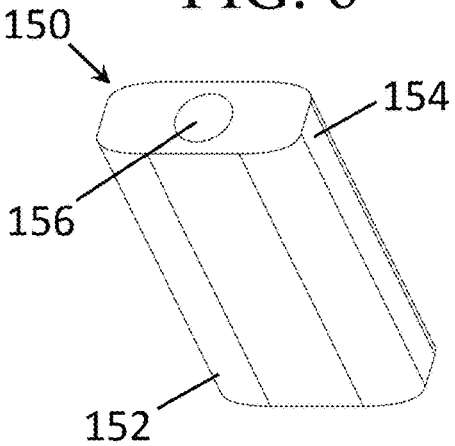
FIG. 8 shows an isometric view of a reservoir of the vaporization device of FIG. 1A according to one example.

FIG. 8 depicts a reservoir 150. The reservoir 150 may be an absorbent reservoir. In this way, the reservoir 150 may be configured to absorb and/or store a liquid therein. Put another way, the reservoir 150 may be configured to have sponge-like qualities (i.e., capable of being squeezed to release the liquid and reabsorbing the liquid). This may solve known problems with standing liquid that are present in existing e-cigarettes. This may also assist in preventing or retarding the ability for the liquid to leak from the reservoir 150. Further yet, this may prevent the heating of more liquid than what is drawn into the vicinity of the heating coil 124 (e.g., by the core element 122), which may thereby prevent undesirable chemical changes in the liquid (e.g., due to constant heating and cooling) and/or undesirable burning tastes during inhalation. In addition, this may be more energy efficient to the extent that less liquid and/or conductive material is drawn into thermal communication with the heating coil 124 (e.g., by the core element 122), which may, in certain examples, require less energy to produce vaporized aerosol therefrom. In examples, the reservoir 150 may be a single, unitary absorbent component. In examples, the reservoir 150 may be a carton or similar device. The reservoir 150 may, in certain examples, serve as a primary storage reservoir for the liquid to be vaporized. With reference to FIG. 2A and FIG. 2B as well, the reservoir 150 may be positioned proximate the first seal 160. In examples, at least a portion of the first seal 160 (e.g., the nipple 164 thereof) may be received within the reservoir 150. In examples, the reservoir 150 may include an opening 156. The opening 156 may extend entirely through the reservoir 150 (e.g., from a first end 152 to an opposite, second end 154 of the reservoir 150). The opening 156 of the reservoir 150 may receive a portion of the first seal 160 (e.g., the nipple 164 thereof) along one end thereof. With reference again to FIG. 2A and FIG. 2B, the reservoir 150 may be positioned proximate the second seal 170. In examples, the first sleeving 130, the second sleeving 140, the heating component 120, and/or a portion of the second seal 170 (e.g., the nipple 174 thereof) may be received within the reservoir. For instance, the opening 156 of the reservoir 150 may receive the first sleeving 130, the second sleeving 140, the heating component 120, and/or a portion of the second seal 170 (e.g., the nipple 174 thereof) along one end thereof (i.e., opposite the first seal 160). The reservoir 150 may be of any size, shape, and/or material as desired to suit a particular application. By way of non-limiting example, the reservoir 150 may have a length of about 26.7 mm, a width of about 14.5 mm, and a height of about 6 mm. By way of further non-limiting example, the opening 156 may have a diameter of about 4 mm. By way of further non-limiting example, the reservoir 150 may have a volume of about 1.4 mL and/or a resistance of about 2.5 Ohms. In examples, the reservoir 150 may include a combination of organic and synthetic materials. The reservoir 150 may, in certain examples, include cotton, a polypropylene material, and/or a polyethylene material, or combinations thereof.

In examples, the capacity of the reservoir 150 can relate to the capacity of the battery 105 such that the reservoir 150 is configured to contain an amount of liquid that is vaporized approximately when the stored energy of the battery 105 is exhausted or nearly exhausted. In this way, the useful life of the battery 105 may substantially coincide with exhaustion of the amount of liquid in the reservoir 150 based upon its consumption during use of the device 100. In such examples, the user may readily understand that the useful life of the vaporization device 100 is exhausted when vaporized aerosol is no longer provided to the user, which, in this example, should coincide with the exhaustion of the battery 105 or the exhaustion of the liquid in the reservoir 150, whichever occurs first. In other examples, the capacity of the reservoir 150 can relate to the capacity of the battery 105 such that the reservoir 150 is configured to contain an amount of liquid that is vaporized before the stored energy of the battery 105 is exhausted or nearly exhausted. In this way, the useful life of the battery 105 may generally be greater than the amount of liquid in the reservoir 150. In such examples, the user may readily understand that the useful life of the vaporization device 100 is exhausted when vaporized aerosol is no longer provided to the user, which, in this example, should coincide with the exhaustion of the liquid in the reservoir 150. Such examples may ensure that all of the liquid in the reservoir 150 is vaporized (e.g., via energization of the heating coil 124 by the battery 105). In further examples, the capacity of the reservoir 150 can relate to the capacity of the battery 105 such that the reservoir 150 is configured to contain an amount of liquid that remains after the stored energy of the battery 105 is exhausted or nearly exhausted. In this way, the useful life of the battery 105 may generally be less than the amount of liquid in the reservoir 150. In such examples, the user may readily understand that the useful life of the vaporization device 100 is exhausted when vaporized aerosol is no longer provided to the user, which, in this example, should coincide with the exhaustion of the battery 105. Such examples may prevent the risk of vaporless actuation (e.g., when the battery 105 energizes the heating coil 124 despite no liquid remaining in the reservoir 150). In addition or alternatively to the foregoing, the capacity of the battery 150 may relate to the resistance of the heating coil 124 (i.e., the capacity of the battery 105 may be tuned to the resistance of the heating coil).

Figure 9:
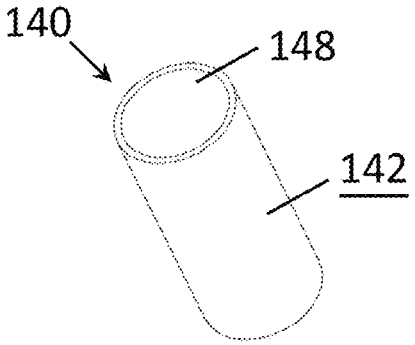
FIG. 9 shows an isometric view of a second sleeving of the vaporization device of FIG. 1A according to one example.

FIG. 9 depicts a second sleeving 140. As will be understood with reference to FIG. 2A and FIG. 2B, at least a portion of the first sleeving 130 may be disposed within the second sleeving 140. In this way, the second sleeving 140 may be configured to tighten the wires of the heating coil 124 (e.g., to tighten an exposed end portion of the heating coil 124 against the outer wall 132 of the first sleeving 130). The provision of the second sleeving 140 may prevent the possibility of damage to the heating component 120, namely the loosening of the heating coil 124. As depicted, the second sleeving 140 may be in the form of an elongate rod or tube, although other examples of the disclosure are not so limited. The second sleeving 140 may include an outer wall 142. The outer wall 142 may generally define and/or bound an interior 148 of the second sleeving 140. The interior 148 of the second sleeving 140 may, in some examples, be a hollow interior designed to receive and accommodate at least a portion of the first sleeving 130 therein and/or therethrough. In certain examples, the first sleeving 130 may be disposed within the second sleeving 140 such that the second sleeving 140 covers the through hole 136 of the first sleeving 130. The second sleeving 140 may assist in preventing or retarding the leakage of liquid through the notch 134 and/or the through hole 136 of the first sleeving 130. The second sleeving 140 may be of any size, shape, and/or material as desired to suit a particular application. By way of non-limiting example, the second sleeving 140 may have a length of about 10 mm, an outer diameter of about 4.5 mm, and/or an inner diameter of about 4 mm. The second sleeving 140 may, in certain examples, be made of fiberglass.

Figure 10A:
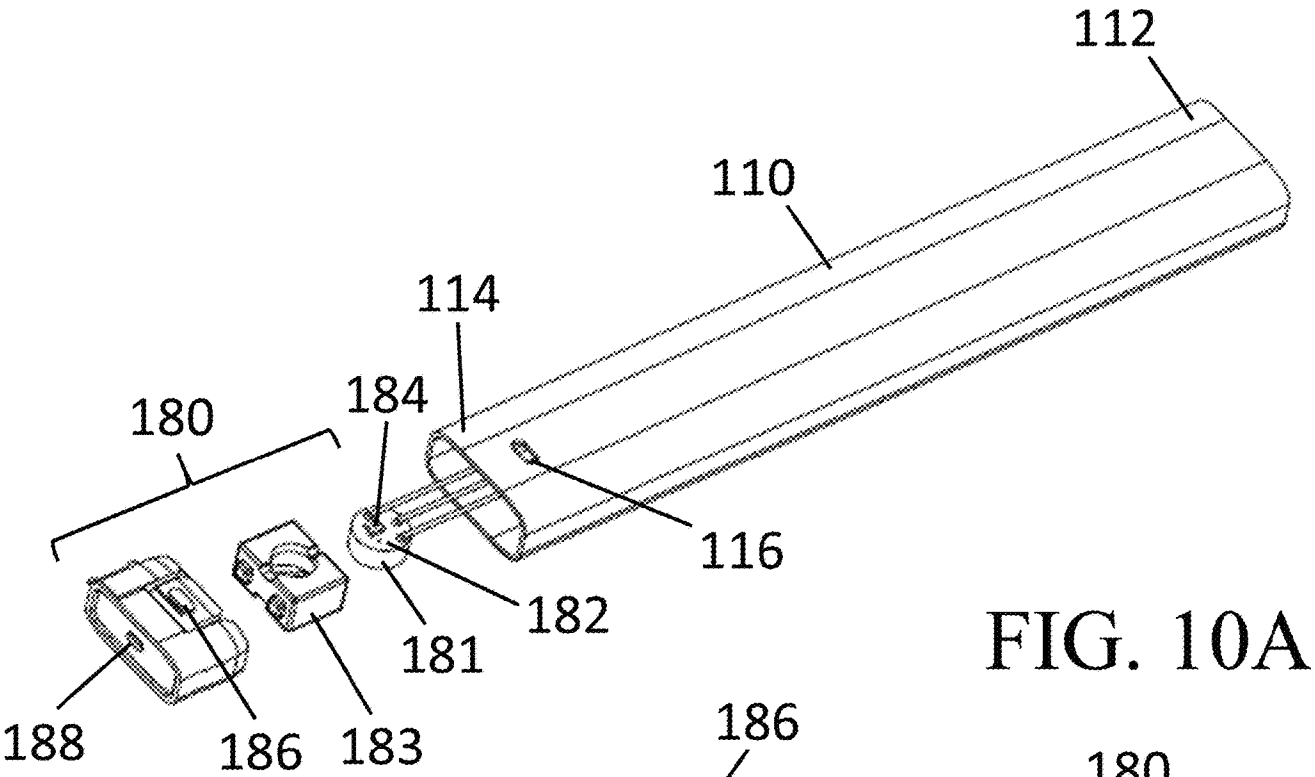
FIG. 10A shows an exploded view of a bottom cap of the vaporization device of FIG. 1A according to one example.
Figure 10B:
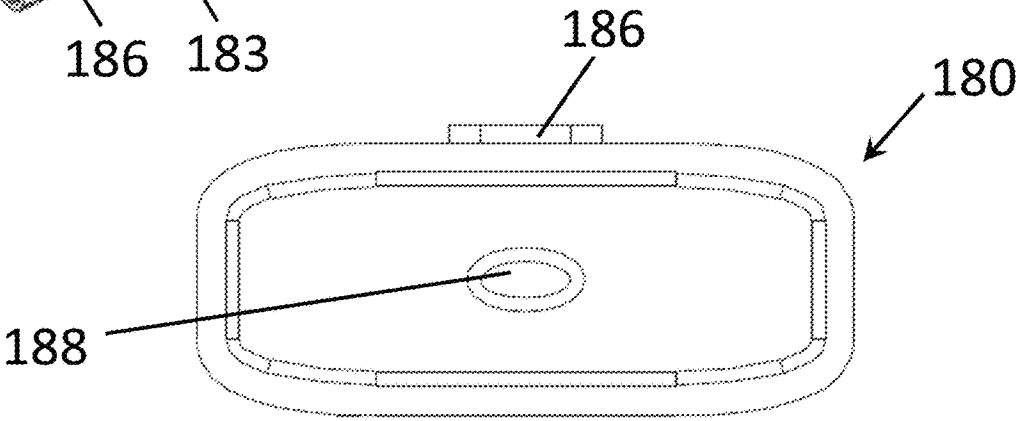
FIG. 10B shows an end view of the bottom cap of FIG. 10A.

Turning now to FIG. 10A and FIG. 10B, certain aspects of the bottom cap 180 may be seen. With reference to FIGS. 1A-2B as well, the bottom cap 180 may be positioned proximate the second end 114 of the housing 110. As explained in detail herein, the bottom cap 180 may be operatively secured to the second end 114 of the housing 110. In certain examples, the bottom cap 180 may be removably connected to the second end 114 of the housing 110. With reference to FIG. 1A and FIG. 2A as well, a substantial portion of the bottom cap 180 may, in some examples, be received within the second end 114 of the housing 110.

Figure 14:
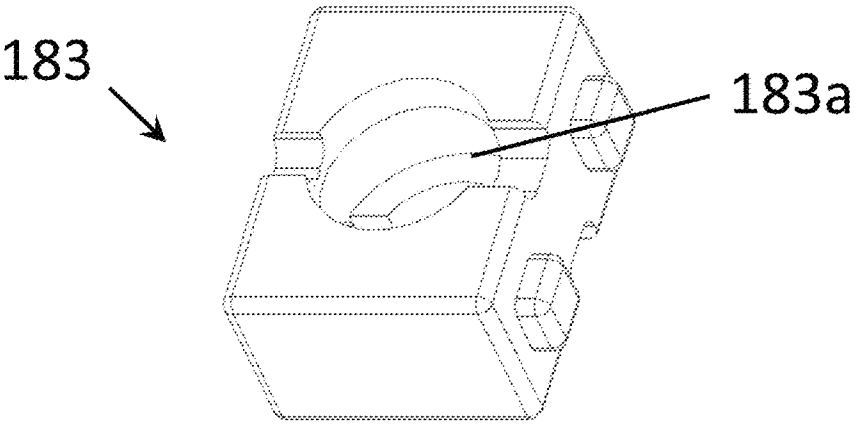
FIG. 14 shows an isometric view of a holder of the vaporization device of FIG. 1A according to one example.

With continued reference to FIG. 10A, the bottom cap 180 includes a controller 181. In examples, the bottom cap 180 further includes a sensor 182. The sensor 182 may, in certain examples, be part of the controller 181. The controller 181 and/or the sensor 182 may, in certain examples, be supported within a holder 183 that is disposed in the bottom cap 180, although other examples of the disclosure are not so limited. The holder 183 may define a cavity 183*a* (refer to FIG. 14) within which the controller 181 and/or the sensor 182 may be supported or otherwise disposed. The holder 183 may, in certain examples, be made of a silicon rubber (e.g., 40° silicon rubber). The sensor 182 may be configured to detect air flow and/or air pressure. For instance, the sensor 182 may, in some examples, be a microphone. In more specific examples, the sensor 182 may be a condenser microphone. In examples in which the sensor 182 is a microphone, the sensor 182 may include a diaphragm configured to move under suction. The diaphragm may be configured to move as air passes through one or more pores 182*b* defined in the sensor 182. Movement of the diaphragm of the sensor 182 may change the measured capacity between the diaphragm (e.g., an exposed trace configured to make contact with the diaphragm) and a front plate separated from the diaphragm (e.g., by an isolating plastic ring and/or a conductive ring). In this way, the sensor 182 may be in the form of a microphone configured to operate as an airflow sensor (i.e., to detect air flow, air pressure, or both). The sensor 182 (e.g., microphone) may, in certain examples, be configured to drive normally under a load of greater than 1.2 Ohms and/or a constant output voltage of about 3.6V. As will be appreciated by those skilled in the art the sensor 182 may take other forms as well, such as a valve (or other sensors that displace mechanically as a result of flow such as turbines) or others. In embodiments, two or more sensors can be used. In embodiments where a quantity of flow can be measured (e.g., the sensor provides more than a binary output), an amount of airflow or suction can be compared to a threshold to determine whether to energize the heating coil 124, or to energize the heating coil 124 to different levels thereby controlling the amount of vapor produced. The sensor 182 may detect air flow or air pressure (e.g., negative pressure) indicative of whether a user is providing a sucking force on the nozzle cap 190. In this way, the controller 181 and/or the sensor 182 may provide a signal indicative of such suction, which may be used as a control by the user to cause the device to provide vaporized aerosol. In examples, the controller 181 and/or the sensor 182 may be configured to provide such a signal to the heating coil 124 when a predetermined negative pressure is reached (e.g., about 400 pascals). In response to the suction, the heating coil 124 may be energized as described herein. Upon heating the liquid via the heating coil 124, the vaporized aerosol or smoke produced thereby may be delivered to the user via the nozzle cap 190 (refer to the vaporized aerosol or smoke flow path illustrated with arrows in FIG. 2A). The controller 181 and/or the sensor 182 may be configured to have a shutoff delay such that the heating coil 124 is energized (and vaporized aerosol is provided to the user) for as long as suction occurs or until a predetermined maximum amount of suction time has elapsed, whichever occurs first. For users with a smaller lung capacity or that prefer smaller draws, this may provide consistent draws according to their preferences. Conversely, for users with a larger lung capacity or that prefer larger draws, this may provide consistent draws for a specific time period (e.g., about 10 seconds). Put another way, the shutoff delay may operate such that in response to continued suction by the user, the heating coil 124 is only energized for a predetermined maximum amount of time (e.g., about 10 seconds). After the predetermined maximum amount of time has been reached, energizing of the heating coil 124 may be ceased, such as by sending a signal to the heating coil 124 to cease energization (e.g., from the controller 181). This may increase safety of the vaporization device 100 by preventing the heating coil 124 from being continuously energized for an extended period of time. In addition, this may ensure the user is provided with an expected and/or consistent amount of vaporized aerosol during each period of suction, including toward the end of the useful life of the vaporization device 100 (e.g., when the battery 105 is nearly exhausted and/or the liquid in the reservoir 105 is nearly exhausted). Advantageously, this may provide the user with a more consistent and pleasing experience and reduce the chances of overheating or burning. Further yet, this may reduce variability of use for calibration of the battery 105, reservoir 150, and/or heating component 120 to exhaust the battery capacity and the liquid in the reservoir 150 at substantially the same time, as described herein.

In examples, an additional or alternative safety shutoff may be provided. In such examples, the controller 181 and/or the sensor 182 may be configured to break the circuit to the heating coil 124 based upon a triggered safety condition (e.g., temperature, voltage, risk of failure). For instance, the controller 181 and/or the sensor 182 may trigger a shutdown condition upon detection of a short, power surge, or overheating. This may prevent problems otherwise arising from accidental actuation or accidentally prolonged actuation, the failure of the controller 181 or the sensor 182, and/or a short circuit (e.g., due to dropping the device or another mechanical or electrical compromise). As described above, in certain examples the battery 105 may be configured to have an output voltage of about 3.5 volts. In examples, if the actual output voltage of the battery 105 is greater than 3.5 volts, the controller 181 and/or the sensor 182 may be configured to cause the battery 105 to output only 3.5 volts. Conversely, in examples, if the actual output voltage of the battery 105 is less than 3.5 volts, the controller 181 and/or the sensor 182 may be configured to cause the battery 105 to output the actual output voltage. In this way, the battery 105 may generally output an actual output voltage of 3.5 volts or less, which may assist in efficient and safe energization of the heating coil 124.

In response to a signal from the controller 181 and/or the sensor 182, the heating coil 124 may be energized to produce vaporized aerosol from the liquid. In certain examples, the heating coil 124 may automatically be energized in response to the signal from the controller 181 and/or the sensor 182 (e.g., a signal indicating negative pressure) without further action. In alternative or complementary examples, a button or similar structure can be used alone or in combination with suction to energize the heating coil 124 and/or to produce vaporized aerosol. In alternative examples, a button or other control can be used independently without the detection of suction to the heating coil 124. In examples, the controller 181 and/or the sensor 182 may assist in ensuring that the user is provided with a consistent amount of vaporized aerosol (e.g., and nicotine) in each draw. Further, the controller 181 and/or the sensor 182 may ensure an optimal amount of vaporized aerosol is provided with respect to the user's lung capacity.

The bottom cap 180 may further include a light source 184. In examples, the light source 184 may be embedded in or otherwise disposed on the controller 181 and/or the sensor 182 (refer to FIG. 13). The light source 184 may be configured to illuminate in response to a signal received from the sensor 182 (e.g., a sensor indicating that the user is providing a sucking force on the nozzle cap 190 and thus desires to be provided with vaporized aerosol). For instance, the light source 184 may, in some examples, be one or more light emitting diodes. The light source 184 may be configured to illuminate whenever the heating coil 124 is energized and/or the user is providing a sucking force and/or when vaporized aerosol is being provided to the user. The light source 184 may be configured to illuminate in different colors (e.g., white) and/or intensities (e.g., dimming) to represent different states of the vaporization device 100 (e.g., providing vaporized aerosol, low battery). Generally, when suction is present, the sensor 182 (e.g., microphone) may be activated and may send a signal to the light source 184 causing the light source 184 to illuminate in response thereto.

The bottom cap 180 may further include a light guide element 186. The light guide element 186 may, in certain examples, serve dual functions. For instance, the light guide element 186 may be configured to operatively secure the bottom cap 180 to the second end 114 of the housing 110. The light guide element 186 may further be configured to permit illuminated light from the light source 184 to pass therethrough.

In examples, the light guide element 186 may interface directly with the second end 114 of the housing 110 to operatively secure the bottom cap 180 thereto. In certain examples, the light guide element 186 may interface with the viewing panel 116 positioned at the second end 114 of the housing 110. When the bottom cap 180 is inserted into the second end 114 of the housing 110, the light guide element 186 and the viewing panel 116 may align with one another (refer to FIG. 1A). In examples, the light guide element 186 and the viewing panel 116 may be shaped complementary to each other. In certain examples, the light guide element 186 may be in the form of a raised detent having a bore therethrough or translucent or semi-transparent portion to permit the passage of light, and the viewing panel 116 may be in the form of a slot configured to at least partially receive the light guide element 186 therein. As will be readily appreciated, these structures could be reversed or modified as desired. The interface between the light guide element 186 and the viewing panel 116 may operatively secure the bottom cap 180 to the second end 114 of the housing 110. In this way, illuminated light from the light source 184 may pass through each of the light guide element 186 and the viewing panel 116. In examples, the bottom cap 180 may include one or more reflective elements or reflective materials designed to amplify the illuminated light from the light source 184 through the light guide element 186 and/or the viewing panel 116. In examples, the light guide element 186 and/or the viewing panel 116 are at least partially transparent to illuminated light from the light source 184 such that the illuminated light may pass therethrough. By way of non-limiting example, the light guide element 186 and/or the viewing panel 116 may be at least 50% transparent to illuminated light from the light source 184, such as at least 75% transparent.

The bottom cap 180 described herein achieves several advantages. For instance, the number of parts is reduced, thereby decreasing production costs and time. Similarly, the assembly process is simplified. Further, as described above, the light guide element 186 serves the dual functions of operatively securing the bottom cap 180 to the housing 110 and guiding illuminated light from the light source 184 therethrough. With respect to operatively securing the bottom cap 180 to the housing 110, a drop test was performed on one of the examples disclosed herein to test the effectiveness and reliability of the interface between the light guide element 186 and the viewing panel 116. For testing, the vaporization device 100 was dropped from a height of 1 meter onto a marble floor with the nozzle cap 190 facing upwards, with the nozzle cap 190 facing downwards, and with the vaporization device 100 oriented sideways. In each test, the interface between the light guide element 186 and the viewing panel 116 remained intact and there was no visible liquid leakage.

The bottom cap 180 may also include a light guide panel 188. The light guide panel 188 may be configured to permit illuminated light from the light source 184 to pass therethrough. In examples, the light guide panel 188 is at least partially transparent to illuminated light from the light source 184 such that the illuminated light may pass therethrough. By way of non-limiting example, the light guide panel 188 may be at least 50% transparent to illuminated light from the light source 184, such as at least 75% transparent. The light guide panel 188 may, in certain examples, be positioned on a surface of the bottom cap 180 (e.g., a bottom surface of the bottom cap 180), and the light guide element 186 may be positioned on a different surface of the bottom cap 180 (e.g., a side surface of the bottom cap 180). In examples, the bottom surface of the bottom cap 180 (e.g., the surface on which the light guide panel 188 is positioned) may be substantially planar. This may provide the vaporization device 100 to be stood upright on a flat surface.

The bottom cap 180 may be of any size, shape, and/or material as desired to suit a particular application. By way of non-limiting example, the bottom cap 180 may have a length of about 14.5 mm, a width of about 6.4 mm, and/or a height of about 8.7 mm. By way of further non-limiting example, the light guide element 186 may have a length of about 3.3 mm, a width of about 1.3 mm, and/or a height of about 0.4 mm. By way of further non-limiting example, the light guide panel 188 may have a length of about 2 mm and/or a width of about 0.8 mm. The bottom cap 180 may, in certain examples, be made of a polycarbonate material.

Figure 11A:
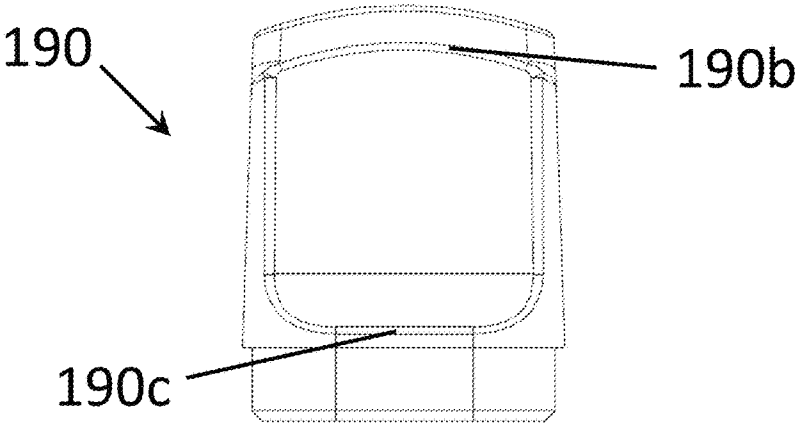
FIG. 11A shows a side view of a nozzle cap of the vaporization device of FIG. 1A according to one example.
Figure 11B:
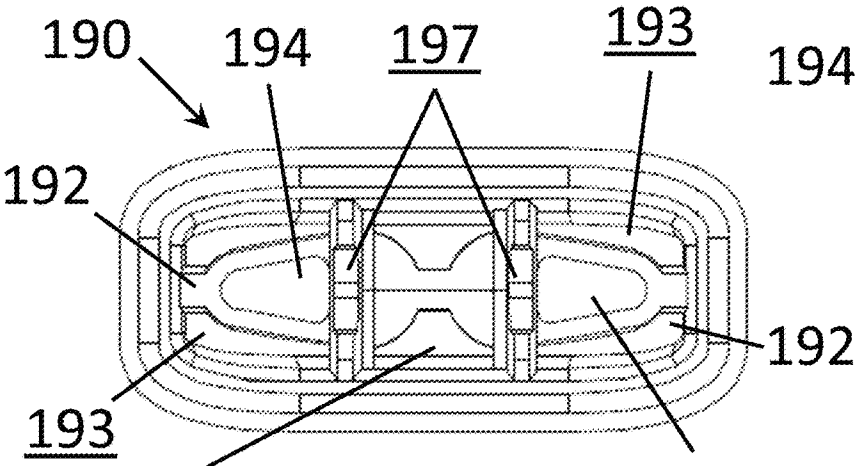
FIG. 11B shows a bottom end view of the nozzle cap of FIG. 11A.
Figure 11C:
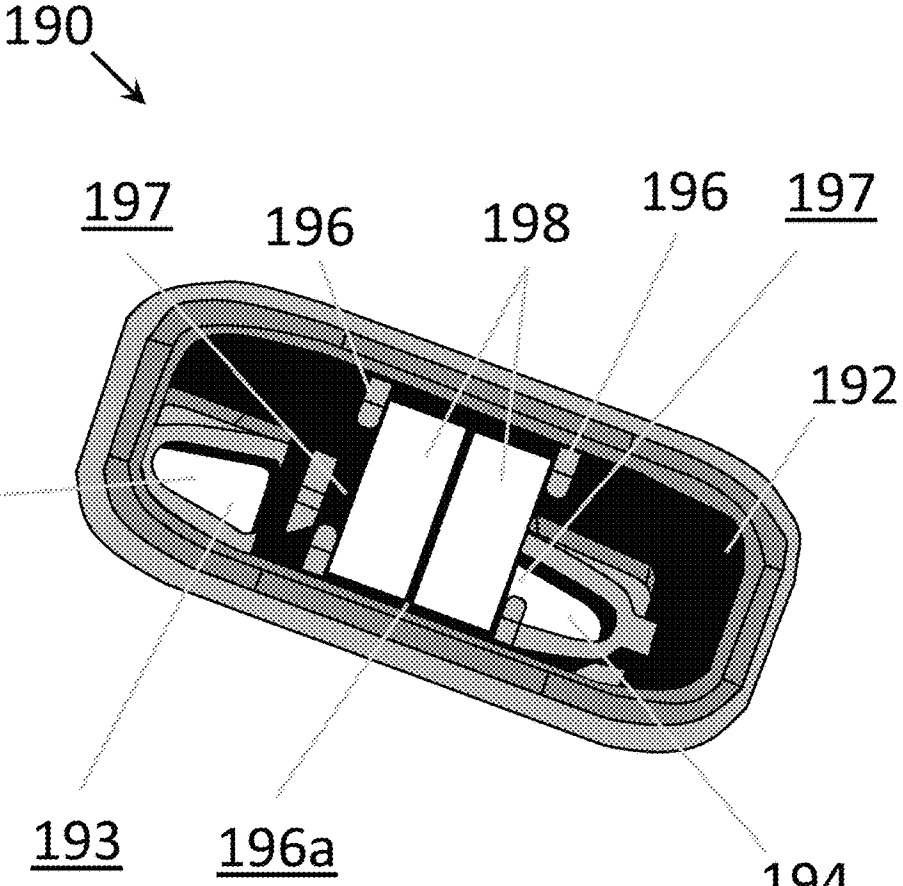
FIG. 11C shows a perspective view of the nozzle cap of FIG. 11A.
Figure 12:
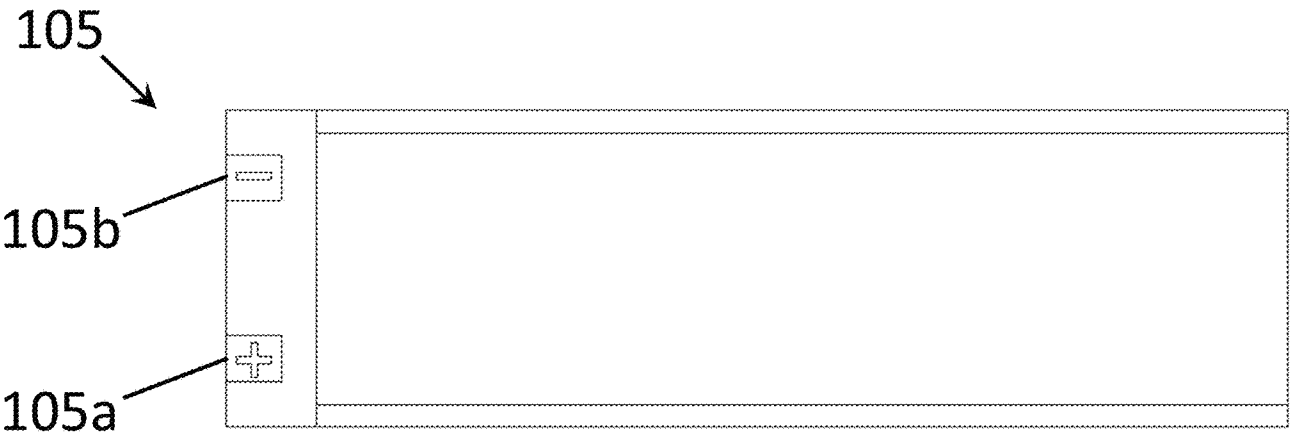
FIG. 12 shows a top view of a battery of the vaporization device of FIG. 1A according to one example.

Turning now to FIGS. 11A-C, certain aspects of the nozzle cap 190 may be seen. With reference to FIGS. 1A-2B as well, the nozzle cap 190 may be positioned proximate the first end 112 of the housing 110. As explained in detail herein, the nozzle cap 190 may be operatively secured to the first end 112 of the housing 110. In certain examples, the nozzle cap 190 may be removably secured to the first end 112 of the housing 110. With reference to FIG. 1A and FIG. 2A as well, a substantial portion of the nozzle cap 190 may extend beyond the first end 112 of the housing 110 (in contrast to a substantial portion of the bottom cap 180 being received within the second end 114 of the housing 110). The nozzle cap 190 being separable from the housing 110 and/or being formed from a different material than the housing may advantageously allow the nozzle cap 190 to expand when heated vapor is passing therethrough and/or time to cool before inhalation. The nozzle cap 190 may be configured to facilitate vapor cooling between vaporization and inhalation.

As shown in FIG. 11A, the nozzle cap 190 may include a first lip 190*b* proximate a distal end thereof (i.e., the end spaced apart from the housing 110 to which the nozzle cap 190 is secured). The first lip 190*b* may be defined by a raised portion of the nozzle cap 190 (i.e., such that the nozzle cap 190 is tapered downward toward the distal end). The first lip 190*b* may be configured to provide a strong seal (e.g., an airtight seal) with a user's lips, particularly for a user who prefers to place only a small portion of the nozzle cap 190 into the user's mouth when providing suction. As also shown in FIG. 11A, the nozzle cap 190 may also include a second lip 190*c* proximate a proximate end thereof (i.e., the end of the nozzle cap 190 that is secured to the housing 110). The second lip 190*c* may be defined by a raised portion of the nozzle cap 190 (i.e., such that the nozzle cap 190 is tapered upward toward the proximate end). The second lip 190*c* may be configured to provide a strong seal (e.g., an airtight seal) with a user's lips, particularly for a user who prefers to place a substantial portion of the nozzle cap 190 into the user's mouth when providing suction. Providing a strong seal with the user's lips may reduction suction noise, prevent external air from being inhaled (which may lead to a more consistent draw), and/or increased comfort.

With reference now to FIG. 11B and FIG. 11C, the nozzle cap 190 defines an air inlet 192. With reference to FIG. 2A and FIG. 2B as well, the air inlet 192 may be positioned proximate the first end 112 of the housing 110. In this way, the air inlet 192 may be configured to receive the vaporized aerosol (e.g., from the heating component 120). The nozzle cap 190 may further define at least one air outlet. In certain examples, first and second air outlets 194 may be provided (refer to FIG. 11B and FIG. 11C). The air outlet(s) 194 may generally be spaced apart from the air inlet 192 along the nozzle cap 190 (e.g., away from the first end 112 of the housing 110). The air outlet(s) 194 may configured to expel the vaporized aerosol (e.g., from the nozzle cap 190 to the user). The nozzle cap 190 may further define an air channel 193. The air channel 193 may extend between the air inlet 192 and the air outlet(s) 194.

With continued reference to FIG. 11B and FIG. 11C, the nozzle cap 190 may include at least one baffle 196. In certain examples, first and second baffles 196 may be provided (refer to FIG. 11B and FIG. 11C). The baffle(s) 196 may at least partially define a cavity 196*a* within the air channel 193. In the example illustrated in FIGS. 11A-C, the cavity 196*a* is defined between first and second baffles 196. The first and second baffles 196 are spaced apart from one another. An oil-absorbing element 198 may be at least partially disposed within the cavity 196*a*. In the example illustrated in FIGS. 11A-C, two oil-absorbing elements 198 are disposed, side-by-side, within the cavity 196*a*. The first and second baffles 196 are spaced apart from one another on opposing sides of the oil-absorbing element(s) 198. The baffle(s) 196 may generally extend from the air inlet 192 to the air outlet(s) 194.

As described herein, the oil-absorbing element(s) 198 may be designed so as to have a high surface area for contact with the vaporized aerosol passing through the air channel 193. As suction is selectively applied and removed from the vaporization device 100, the energization of the heating coil 124 (i.e., heating) and cessation thereof (i.e., cooling) may cause vaporized condensation of nicotine or other liquid in the nozzle cap 190, which may undesirably lead to the user being provided with condensation or droplets of undesirably strong or burnt-tasting liquid rather than the intended vaporized aerosol. The oil-absorbing element(s) 198 may, in some examples, be configured to prevent or retard such condensation or water vapor from passing through the air channel 193 to the air outlet(s) 194. Advantageously, this may prevent or retard water vapor from being carried into the user's lungs when the user inhales the vaporized aerosol. As the user provides suction to receive vaporized aerosol, the vaporized aerosol may be provided such that a substantial portion of the vaporized aerosol travels from the air inlet 192 to the air outlet(s) 194 generally along the center of the air channel 193. In examples, the oil-absorbing element(s) 198 may be arranged proximate a center of the nozzle cap 190 and/or a center of the air channel 193. Put another way, the oil-absorbing element(s) 198 may be positioned in-line within the air channel 193. In examples, the number of oil-absorbing elements 198 may coincide with the number of air outlets 194, although other examples are not so limited. For instance, in one example, the nozzle cap 190 may include a single air outlet 194 and one oil-absorbing element 198 positioned in the air channel 193 in-line with the air outlet 194. In another example, the nozzle cap 190 may include a pair of air outlets 194 and a pair of oil-absorbing elements 198 each positioned in the air channel 193 in-line with one of the air outlets 194. In examples in which multiple air outlets 194 are provided, the air outlets 194 may generally be connected to one another by a central opening (refer to FIG. 11B), and one or more oil-absorbing elements 198 may be provided (e.g., in-line with the central opening). As described herein, the use of one or more oil-absorbing elements 198 may assist in preventing or retarding condensate or water vapors from reaching the user's lips. In certain examples as described herein, the nozzle cap 190 may be designed to be sufficiently long (e.g., greater than about 20 mm) to assist in preventing or retarding condensate or water vapors from reaching the user's lips without the use of one or more oil-absorbing elements 198 (or in addition thereto). In examples in which the nozzle cap 190 is designed to be shorter (e.g., less than about 10 mm), one or more oil-absorbing elements 198 may be provided to assist in preventing or retarding condensate or water vapors from reaching the user's lips as described herein.

In examples, the baffle(s) 196 may at least partially occlude the oil-absorbing element(s) 198 from direct exposure to the air channel 193. The portion(s) of the baffle(s) 196 that occludes the oil-absorbing element(s) 198 from direct exposure to the air channel 193 may further provide support for the oil-absorbing element(s) 198 and/or serve to define the cavity 196*a* within which the oil-absorbing element(s) 198 may be disposed. In certain examples, the baffle(s) 196 may define one or more notches 197. The notch(es) 197 may be configured to expose the oil-absorbing element(s) 198 to the air channel 193. The portion(s) of the oil-absorbing element(s) 198 exposed to the air channel 193 (e.g., by the one or more notches 197) may absorb condensate so as to prevent or retard such condensate from being provided to the user with the vaporized aerosol.

The nozzle cap 190 described herein achieves several advantages. For instance, the delivery distance from the air inlet 192 to the air outlet(s) 194 is effectively lengthened, thereby reducing the temperature of the vaporized aerosol to a suitable temperature (e.g., less than about 48° C.). With respect to reducing the temperature of the vaporized aerosol to a suitable temperature, a nozzle temperature test was performed on one of the examples disclosed herein to test the effectiveness and reliability of the of the nozzle cap 190. The vaporization device 100 was attached to a suction machine and suction was applied for about 2 seconds and then suction was ceased for about 8 seconds. The initial surface temperature and the surface temperature of the nozzle cap 190 after suction were detected at the beginning of each suction. In each test, the surface temperature of the nozzle cap 190 did not exceed 48° C. Table 1 below shows the surface temperature of the nozzle cap 190 for each listed parameter.

TABLE 1

| Test No. | Suction Pressure 4 kPa | Suction for 2 s; Stopping for 8 s | Point Temperature Line 6# | Test Temperature 25.7° C. | Initial Temperature 26.7° C. |
|---|---|---|---|---|---|
| Test 1 | 31.4° C. | 33.2° C. | 34.4° C. | 35.6° C. | 36.3° C. |
| Test 2 | 36.6° C. | 36.9° C. | 37.0° C. | 37.0° C. | 37.1° C. |
| Test 3 | 36.9° C. | 36.9° C. | 36.9° C. | 36.7° C. | 36.5° C. |

With respect to condensate absorption by the oil-absorbing element(s) 198, a test was performed to test the effectiveness and reliability of the of the oil-absorbing element(s) 198. To perform the test, the output of the battery 105 was maximized, the smoking rate was set to about 17.5 mL/s, and suction was applied for about 2-3 seconds and then ceased for about 8-10 seconds. In each test, there was effective oil absorption by the oil-absorbing element(s) 198 and no condensate was detected.

The nozzle cap 190 may be of any size, shape, and/or material as desired to suit a particular application. By way of non-limiting example, the nozzle cap 190 may have a length of about 15.5 mm, a width of about 7 mm, and/or a height of about 20 mm. By way of further non-limiting example, the baffle(s) 196 may have a width of about 0.8 mm. By way of further non-limiting example, the oil-absorbing element may have a length of about 15 mm, a width of about 4 mm, and/or a height of about 1.8 mm. The nozzle cap 190 may, in certain examples, be made of an acrylonitrile butadiene styrene (ABS) material. The oil-absorbing element may, in certain examples, include cotton and/or a plant fiber (e.g., organic or synthetic cotton). In certain examples, the oil-absorbing element may be made of a surgical-grade cotton. The length of the nozzle cap 190 may be selected or optimized to reduce the temperature of the vaporized aerosol to an acceptable level. By way of non-limiting example, the nozzle cap 190 may have a length (i.e., measured between the air inlet 192 and the air outlet 194 along the air channel 193) of from about 10 mm to about 20 mm. In addition or alternative to reducing the temperature of the vaporized aerosol to an acceptable level, the length of the nozzle cap 190 may further prevent condensate or water vapors from passing to the user and/or may further prevent the user from undesirable or potentially harmful electrical shocks that have been known to occur in existing e-cigarettes.

Figure 16:
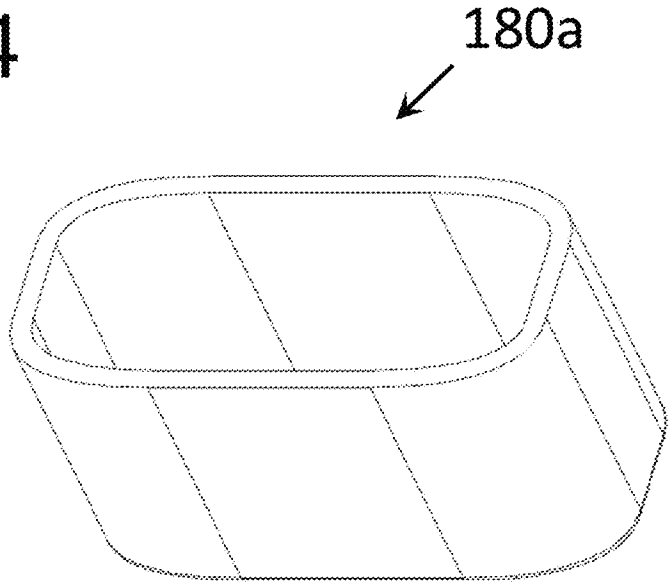
FIG. 16 shows an isometric view of a bottom cap case according to one example.
Figure 15:
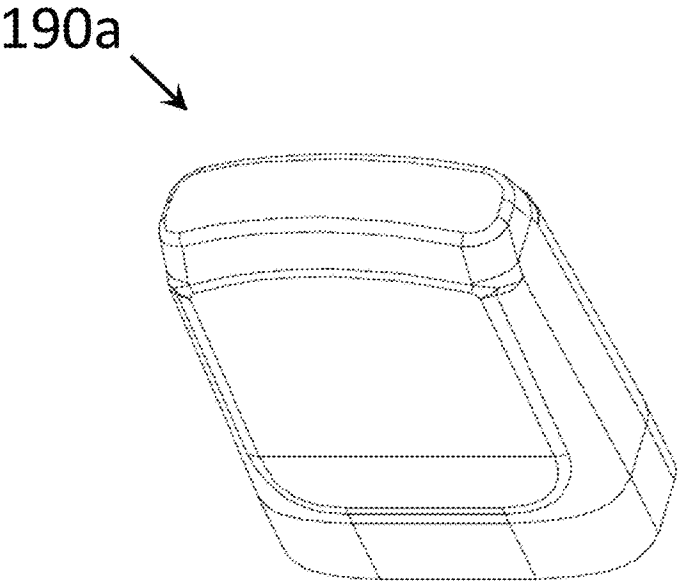
FIG. 15 shows an isometric view of a nozzle cap case according to one example.

During transportation, the orientation of the vaporization device may be changed frequently or rapidly, which often makes conventional vaporization devices susceptible to leakage. Thus, during transportation of the vaporization device 100 described herein, it is important to prevent or retard the leakage of the liquid (e.g., the nicotine-containing liquid) therefrom. The vaporization device 100 described herein may include a nozzle cap case 190*a*, such as is illustrated in FIG. 15. Generally, the nozzle cap case 190*a* may be configured to fit over the nozzle cap 190 so as to at least partially encompass the nozzle cap 190. In examples, the nozzle cap case 190*a* may be configured to fit snugly over the nozzle cap 190 so as to assist in preventing or retarding the leakage of liquid from the vaporization device 100 via the nozzle cap 190. The nozzle cap case 190*a* is generally sized and shaped so as to be complementary to the nozzle cap 190 so as to fit over the nozzle cap 190 as described above. By way of non-limiting example, the nozzle cap case 190*a* may have a length of about 15.7 mm, a width of about 7.2 mm, and/or a height of about 19.9 mm. In the same or alternative examples, the vaporization device 100 described herein may include a bottom cap case 180*a*, such as is illustrated in FIG. 16. Generally, the bottom cap case 180*a* may be configured to fit over the bottom cap 180 so as to at least partially encompass the bottom cap 180. In examples, the bottom cap case 180*a* may be configured to fit snugly over the bottom cap 180 so as to assist in preventing or retarding the leakage of liquid from the vaporization device 100 via the bottom cap 180. The bottom cap case 180*a* is generally sized and shaped so as to be complementary to the bottom cap 180 so as to fit over the bottom cap 180 as described above. By way of non-limiting example, the bottom cap case 180*a* may have a length of about 15.9 mm, a width of about 7.4 mm, and/or a height of about 8.7 mm.

It should be noted that the illustrations and descriptions of the examples shown in the figures are for exemplary purposes only and should not be construed as limiting the disclosure. One skilled in the art will appreciate that the present disclosure contemplates various examples. Additionally, it should be understood that the concepts described above with the above-described examples may be employed alone or in combination with any of the other examples described above. It should further be appreciated that the various alternative examples described above with respect to one illustrated example can apply to all examples as described herein, unless otherwise indicated.

Unless explicitly stated otherwise, each numerical value and range should be interpreted as being approximate as if the word "about," "approximately," or "substantially" preceded the value or range. The terms "about" and "approximately" can be understood as describing a range that is within 15 percent of a specified value unless otherwise stated.

Conditional language used herein, such as, among others, "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements, and/or steps are in any way required for one or more examples or that one or more examples necessarily include these features, elements and/or steps. The terms "comprising," "including," "having," and the like are synonymous and are used inclusively, in an open-ended fashion, and do not exclude additional elements, features, acts, operations, and so forth.

While certain examples have been described, these examples have been presented by way of example only and are not intended to limit the scope of the inventions disclosed herein. Thus, nothing in the foregoing description is intended to imply that any particular feature, characteristic, step, module, or block is necessary or indispensable. Indeed, the novel methods and articles described herein may be embodied in a variety of other forms; furthermore, various omissions, substitutions, and changes in the form of the methods and articles described herein may be made without departing from the spirit of the inventions disclosed herein. The accompanying claims and their equivalents are intended to cover such forms or modifications as would fall within the scope and spirit of certain of the inventions disclosed herein.

It will be understood that reference herein to "a" or "one" to describe a feature such as a component or step does not foreclose additional features or multiples of the feature. For instance, reference to a device having or defining "one" of a feature does not preclude the device from having or defining more than one of the feature, as long as the device has or defines at least one of the feature. Similarly, reference herein to "one of" a plurality of features does not foreclose the invention from including two or more, up to all, of the features. For instance, reference to a device having or defining "one of a X and Y" does not foreclose the device from having both the X and Y.

What is claimed:

1. A vaporization device, comprising:

a housing having a first end and a second end opposite the first end thereof;

a bottom cap operatively secured to the second end of the housing, the bottom cap comprising:

a sensor configured to detect air flow or air pressure or both;

a light source configured to illuminate in response to a signal received from the sensor;

a light guide element configured to operatively secure the bottom cap to the second end of the housing and to permit illuminated light from the light source to pass therethrough; and a viewing panel defined by a slot in the housing proximate the second end thereof and configured to permit illuminated light from the light source to pass therethrough and to interface directly with the light guide element by at least partially receiving the light guide element therein so as to operatively secure the bottom cap to the second end of the housing.

2. The vaporization device of claim 1, wherein the bottom cap is removably secured to the second end of the housing.

3. The vaporization device of claim 1, wherein the housing extends from the first end to the second end thereof along a first axis and the viewing panel is configured to align with the light guide element and the light source along a second axis substantially perpendicular to the first axis when the bottom cap is operatively secured to the housing such that the illuminated light from the light source passes through the viewing panel.

4. The vaporization device of claim 1, wherein the viewing panel is shaped complementary to the light guide element.

5. The vaporization device of claim 1, wherein the light guide element is a raised detent extending outwardly away from the bottom cap and into the slot in the housing.

6. The vaporization device of claim 1, wherein the light source is disposed on the sensor or is embedded in the sensor.

7. The vaporization device of claim 1, further comprising a light guide panel spaced apart from the light guide element and configured to permit illuminated light from the light source to pass therethrough.

8. The vaporization device of claim 7, wherein the housing extends from the first end to the second end thereof along an axis, the light guide panel is positioned on a bottom surface of the bottom cap, and the light guide element is positioned on a side surface of the bottom cap, the bottom surface of the bottom cap extending substantially perpendicular to the axis and the side surface of the bottom cap extending substantially parallel to the axis.

9. The vaporization device of claim 1, wherein the bottom cap defines a substantially planar bottom configured to permit the vaporization device to stand upright when the bottom is brought to rest upon a flat supporting surface.

10. The vaporization device of claim 1, further comprising a holder defining a cavity within which the sensor is at least partially disposed.

11. The vaporization device of claim 10, wherein the holder is made of a silicon rubber.

12. The vaporization device of claim 1, wherein the bottom cap includes a body within which the sensor and light source are disposed, the body including the light guide element.

13. The vaporization device of claim 12, wherein the body of the bottom cap is made of a first material and the housing is made of a second material different from the first material.

14. The vaporization device of claim 13, wherein the first material is a polycarbonate material.

15. The vaporization device of claim 13, wherein the second material is aluminum.

16. The vaporization device of claim 1, wherein the bottom cap includes one or more reflective elements configured to amplify illuminated light from the light source through the light guide element.

17. The vaporization device of claim 1, wherein the sensor is configured to execute a shutdown condition when an unsafe condition is detected.

18. The vaporization device of claim 1, wherein the sensor is a microphone.

19. A vaporization device, comprising:

a housing extending from a first end to a second end thereof opposite the first end thereof along an axis;

a bottom cap operatively secured to the second end of the housing, the bottom cap comprising:

a sensor configured to detect air flow or air pressure or both;

a light source configured to illuminate in response to a signal received from the sensor;

a light guide element positioned on a side surface of the bottom cap and configured to operatively secure the bottom cap to the second end of the housing and to permit illuminated light from the light source to pass therethrough, the side surface of the bottom cap extending substantially parallel to the axis; and a light guide panel positioned on a bottom surface of the bottom cap and configured to permit illuminated light from the light source to pass therethrough, the bottom surface of the bottom cap extending substantially perpendicular to the axis.

20. The vaporization device of claim 19, further comprising a viewing panel defined by a slot in the housing proximate the second end thereof and configured to permit illuminated light from the light source to pass therethrough and to interface directly with the light guide element by at least partially receiving the light guide element therein so as to operatively secure the bottom cap to the second end of the housing.

* * * * *